US005885001A

United States Patent [19]

Thomas

[11] Patent Number: 5,885,001

[45] Date of Patent: Mar. 23, 1999

[54] AGITATOR ASSEMBLY WITH A RETRACTABLE BLADE ASSEMBLY

[75] Inventor: Malcom H. Thomas, Doraville, Ga.

[73] Assignee: Cadence Technologies, Inc., Alpharetta, Ga.

[21] Appl. No.: 874,379

[22] Filed: Jun. 13, 1997

[51] Int. Cl.[6] ..... B01F 7/20

[52] U.S. Cl. ..... 366/308; 464/182

[58] Field of Search ..... 366/129, 130, 366/308, 342, 343; 464/179, 182; 403/315, 331, 353

[56] References Cited

U.S. PATENT DOCUMENTS

| | | | |
|---|---|---|---|
| 955,978 | 4/1910 | Mitchell | 366/308 X |
| 1,932,436 | 10/1933 | Barnhill | 403/353 |
| 1,943,194 | 1/1934 | Vachoux | 366/308 X |
| 2,114,127 | 4/1938 | Nueberth | 403/331 |
| 2,144,715 | 1/1939 | Dalzell et al. | 366/308 |
| 2,204,103 | 6/1940 | Lampkin | 403/331 |
| 2,852,238 | 9/1958 | Varkony | 366/308 |
| 2,896,926 | 7/1959 | Chapman | 366/129 X |
| 3,092,403 | 6/1963 | Gerdeman | 403/331 X |
| 3,559,962 | 2/1971 | Enssle et al. | 366/308 |
| 4,083,653 | 4/1978 | Stiffler | 366/308 X |
| 4,872,764 | 10/1989 | McClean | 366/308 |
| 5,192,131 | 3/1993 | Hatfield | 366/308 |
| 5,489,151 | 2/1996 | Weber | 366/308 |

FOREIGN PATENT DOCUMENTS

| | | | |
|---|---|---|---|
| 164303 | 12/1985 | European Pat. Off. | 366/308 |
| 1720697 | 3/1992 | U.S.S.R. | 366/308 |

*Primary Examiner*—Charles E. Cooley
*Attorney, Agent, or Firm*—Pitts & Brittian, P.C.

[57] ABSTRACT

An agitator assembly for use in conventional food and beverage processing vats. The agitator assembly generally includes a shaft and a retractable blade assembly secured to a second end of the shaft. A first end of the shaft is securable to the agitator drive. The retractable blade assembly includes a lifting collar and an agitator shaft which cooperate such that the blades of the retractable blade assembly are retractable and extendable With the blades of the retractable blade assembly in a retracted position, the assembly can pass through the opening in the top of a conventional mixing vat cover. Moreover, the shaft is separable via a quick release split coupling such that once the first end of the shaft is secured to the agitator shaft it does not have to be disconnected to remove the remaining portion of the agitator assembly from the vat.

16 Claims, 6 Drawing Sheets

AGITATOR ASSEMBLY WITH A RETRACTABLE BLADE ASSEMBLY

TECHNICAL FIELD

This invention relates to the field of agitator assemblies for food and beverage processing vats.

BACKGROUND ART

In the field of food and beverage processing, ingredients are mixed in large vats via an agitator assembly which is driven by an agitator drive. Conventionally, the agitator assembly defines a shaft, a first end of which is received through a small opening defined by the top cover of the vat. The opening is sized to closely receive the shaft and prevent impurities from entering the vat. The second end of the shaft extends to a lower portion of the vat and defines blades for mixing when the shaft is rotated via the agitator drive. The agitator assembly is secured to the agitator drive in a manner such that the agitator assembly is not easily disconnected from the drive. Moreover, removal of the agitator assembly from the vat requires removal of the top of the vat because the blades prevent the agitator assembly from being passable through the opening at the top of the vat.

The bottom of a conventional vat defines a truncated conical configuration. The blades of a conventional agitator assembly extend to be proximate the side of the vat at an upper end thereof such that the agitator assembly can not be lowered to within inches of the bottom of the tank. With this configuration contents at the bottom of the tank are not sufficiently agitated which results in improper mixing of the contents in the vat.

Therefore, it is an object of the present invention to provide an agitator assembly wherein the blades are retractable such that the assembly is receivable through the opening in the top cover of a conventional mixing vat.

It is another object of the present invention to provide an agitator assembly which includes a means for quickly connecting and disconnecting the shaft of the agitator assembly such that the upper end of the agitator assembly does not have to be disconnected from the agitator drive.

It is yet another object of the present invention to provide an agitator assembly wherein the blades are retractable and extend from the shaft under centrifugal forces.

Further, it is an object of the present invention to provide an agitator assembly wherein the blades are positionable proximate the bottom of the vat to ensure thorough mixing of the contents in the vat.

SUMMARY

Other objects and advantages will be accomplished by the present invention which provides an agitator assembly for a conventional food and beverage mixing vat. The agitator assembly of the present invention generally includes a shaft and a retractable blade assembly secured to a second end of the shaft. A first end of the shaft is securable to the agitator drive. With the blades of the retractable blade assembly in a retracted position, the assembly can pass through the opening in the top of a conventional mixing vat cover. Moreover, the shaft is separable via a quick release split coupling such that once the first end of the shaft is secured to the agitator shaft it does not have to be disconnected to remove the remaining portion of the agitator assembly.

BRIEF DESCRIPTION OF THE DRAWINGS

The above mentioned features of the invention will become more clearly understood from the following detailed description of the invention read together with the drawings in which.

DESCRIPTION OF PREFERRED EMBODIMENTS

An agitator assembly for use in food or beverage processing vats incorporating various features of the present invention is illustrated generally at 10 in the figures. The agitator assembly 10 is designed to be removable through the opening of a conventional mixing vat cover. Moreover, the agitator assembly 10 is designed such that the blades are positionable proximate the bottom of a conventional mixing vat. Further, in the preferred embodiment, the retractable blades extend away from the shaft via centrifugal forces.

Figure 1:
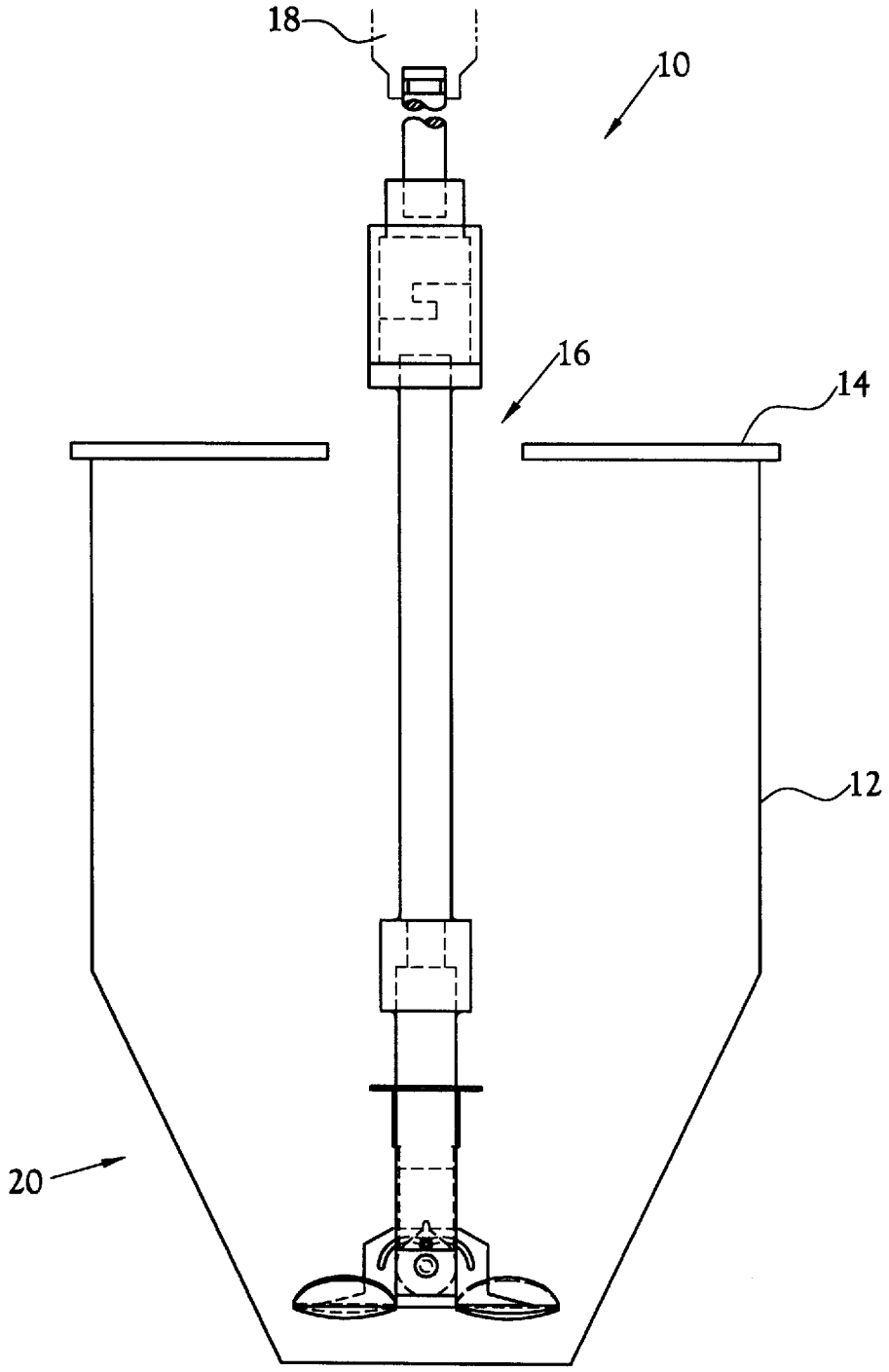
FIG. 1 is a perspective view of the agitator assembly positioned in a conventional food and beverage mixing vat.

FIG. 1 illustrates a conventional mixing vat 12 including a vat cover 14 with the agitator assembly 10 of the present invention received through the vat cover 14 and supported in the mixing vat 12. A conventional vat cover 14 defines an opening 16 for receiving the shaft of a mixing assembly therethrough. The opening 16 is approximately three inches in diameter. It will be noted that a conventional mixing vat 12 defines a truncated conical configuration 20 at the bottom end thereof. Conventional agitator assemblies are not configured to extend to a position proximate the bottom of the mixing vat because of the configuration of the blades of a conventional agitator assembly.

Figure 2:
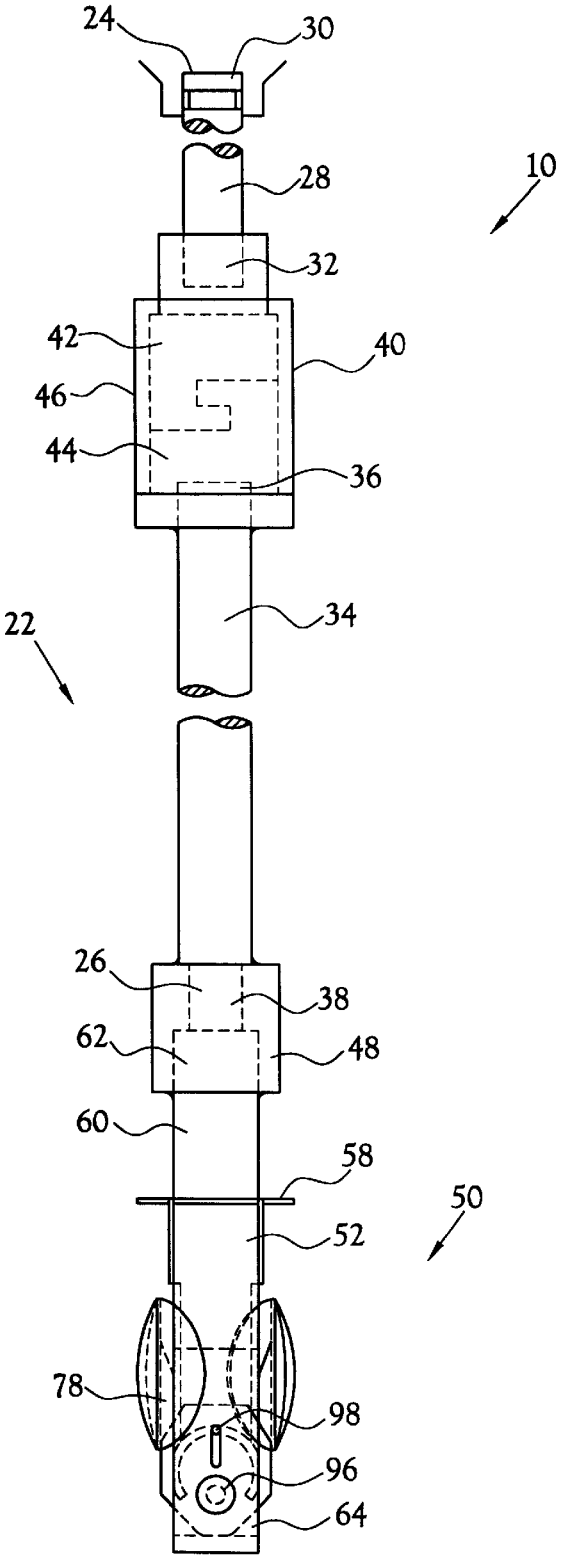
FIG. 2 is a perspective view of the agitator assembly constructed in accordance with several features of the present invention showing the retractable blade assembly in a retracted or folded up position.

Referring to FIG. 2, the agitator assembly 10 is generally comprised of a shaft 22 and a retractable blade assembly 50. The first end 24 of the shaft 22 is secured to the agitator drive 18 and the retractable blade assembly 50 is secured to the second end 26 of the shaft 22. In the preferred embodiment, the shaft 22 is separable such that the first end 24 of the shaft 22 does not have to be removed from the agitator drive 18 to remove the agitator assembly 10 from the vat 12. Preferably, the shaft 22 is separable via a quick release split coupling 40.

In the preferred embodiment, the shaft 22 is comprised of a drive shaft 28, a main shaft 34 and a quick release split coupling 40 for joining the drive shaft 28 and the main shaft 34, as shown in FIG. 2. A first end 30 of the drive shaft 28 is configured for insertion in the agitator drive 18 and a second end 32 of the drive shaft 28 is secured in the upper end of the quick release split coupling 40. A first end 36 of the main shaft 34 is secured in the lower end of the quick release split coupling 40. Preferably, the quick release split coupling 40 is positioned above the vat cover 14, as shown in FIGS. 1 and 2. The second end 38 of the main shaft 34 is secured to the retractable blade assembly 50. In the preferred embodiment, the drive shaft 28 and the main shaft 34 each define a diameter of approximately one inch.

Figure 3:
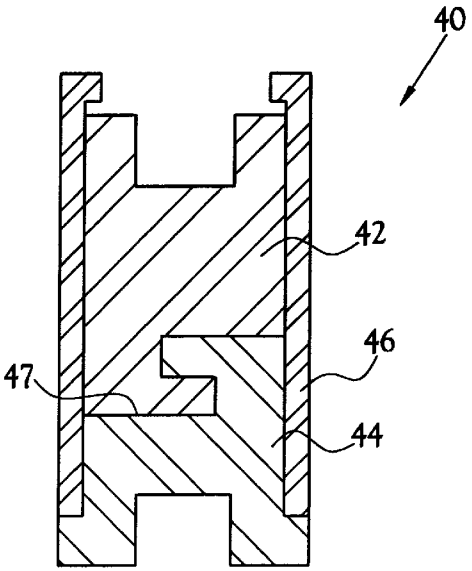
FIG. 3 illustrates a cross sectional view of the quick release split coupling.

A cross sectional view of the quick release split coupling 40 is shown in FIG. 3. It is comprised of an upper portion 42, a lower portion 44 and a sheath 46. The second end 32 of the drive shaft 28 is secured to the upper portion 42, and the first end 36 of the main shaft 34 is secured to the lower portion 44. The upper portion 42 and the lower portion 44 are configured to interlock. The sheath 46 is received over the upper and lower portions 42, 44 to maintain them in an interlocked position. To release the upper and lower portions 42, 44, the sheath 46 is lifted to reveal the interlocking site 47 such that the lower portion 44 can be disengaged from the upper portion 42. In the preferred embodiment, the outer diameter of the quick release split coupling 40 is approximately 2.5 inches. It will be noted that the main shaft 34 can vary in length, and its length will depend upon the depth of the vat 12 in which the agitator assembly 10 is used.

Figure 4:
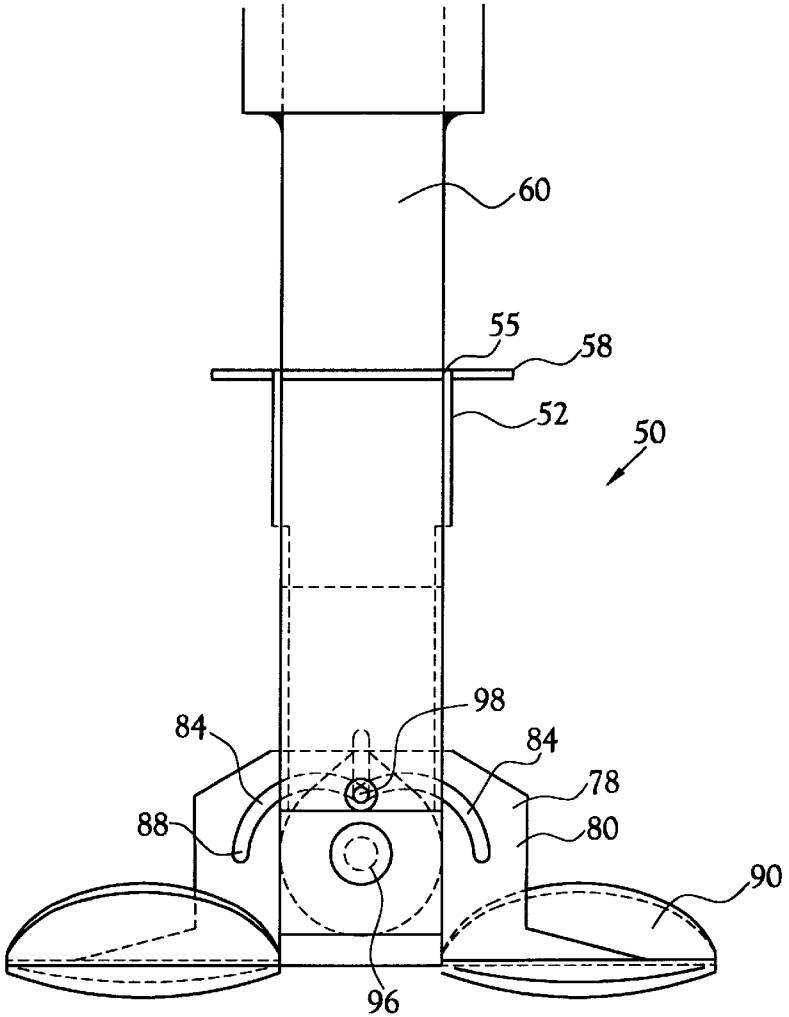
FIG. 4 is a view of the retractable blade assembly with the blades in an open or extended position.

In the preferred embodiment, the retractable blade assembly 50 is generally comprised of an agitator shaft 60, a lifting collar 52 and two blades 78, as shown in FIG. 4. A first end 62 of the agitator shaft 60 is secured to the second end 38 of the main shaft 34, preferably, via a shaft coupling 48, as shown in FIG. 2. In the preferred embodiment, the shaft coupling 48 is approximately two inches in diameter. The blades 78 are retractable for permitting the removal of the agitator assembly 10 through the opening 16 in the vat cover 14. In the preferred embodiment, the blades 78 pivot with respect to the agitator shaft 60. Further, in the preferred embodiment, the blades 78 are limited to a range of motion from an open position, as shown in FIG. 4, to a retracted position, as shown in FIG. 2.

Figure 5:
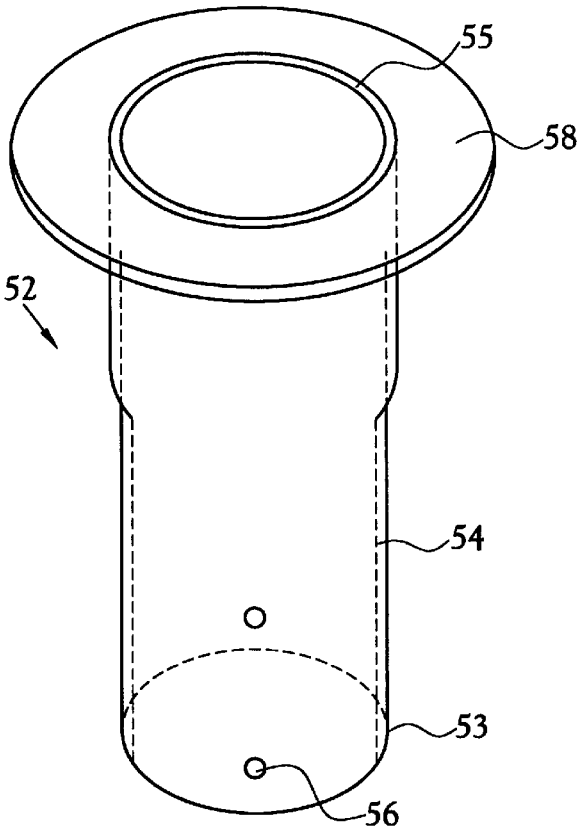
FIG. 5 illustrates a perspective view of the lifting collar of the retractable blade assembly.
Figure 6:
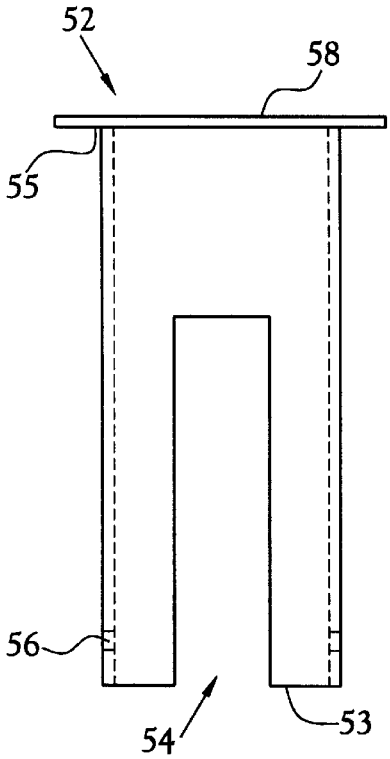
FIG. 6 is a side view of the lifting collar.

A perspective view of the lifting collar 52 is illustrated in FIG. 5 and a side view is shown in FIG. 6. The lifting collar 52 is cylindrical and defines two slots 54 which are oppositely disposed. The slots 54, shown clearly in FIG. 6, are axially cut into the collar 52 and extend from the lower end 53 of the lifting collar 52. The lifting collar 52 also defines two lifting pin openings 56 oppositely disposed and at a lower end 53 thereof. The lifting pin openings 56 are disposed approximately 90° from the slots 54. The lifting collar 52 is slidably received by the agitator shaft 60. In the preferred embodiment, the lifting collar 52 defines a rim 58 which radially extends from an upper end 55 thereof.

Figure 7:
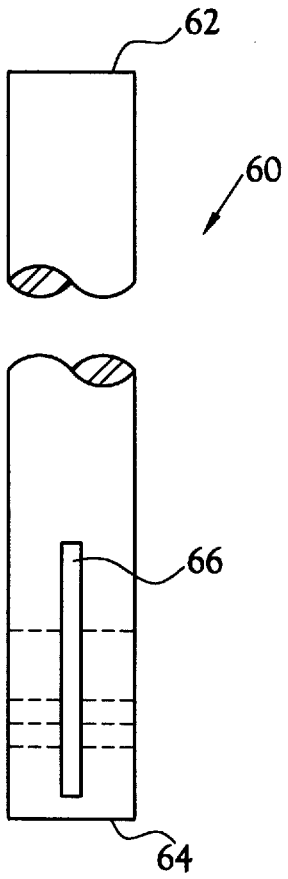
FIG. 7 is a side view of the agitator shaft of the retractable blade assembly.
Figure 8:
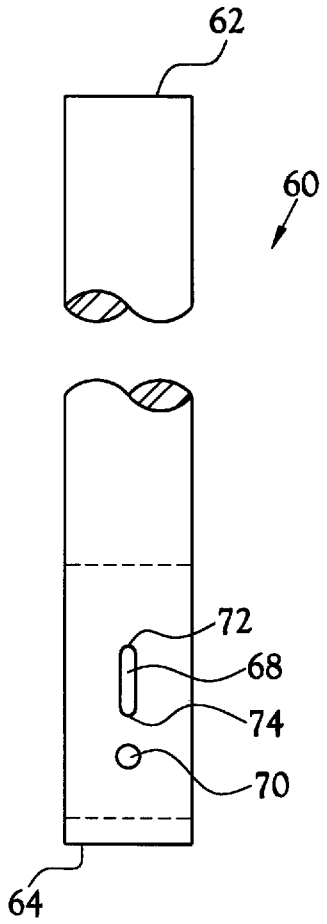
FIG. 8 is a side view of the agitator shaft, 90° from the side view of FIG. 7.

Side views of the agitator shaft 60 are shown in FIGS. 7 and 8. A first end 62 of the agitator shaft 60 is secured to the shaft coupling 48. The agitator shaft 60 defines a blade arm slot 66 extending through the shaft 60 proximate a second end 64 thereof, as shown in FIG. 7. Further, the agitator shaft 60 defines a shaft lifting pin slot 68 and a shaft pivot pin opening 70 therethrough proximate the second end 64, as shown in FIG. 8. The shaft lifting pin slot 68 defines an upper end 72 and a lower end 74. The blade arm slot 66 is disposed 90° from the shaft lifting pin slot 68 and the shaft pivot pin opening 70, as shown in FIGS. 7 and 8.

Figure 9:
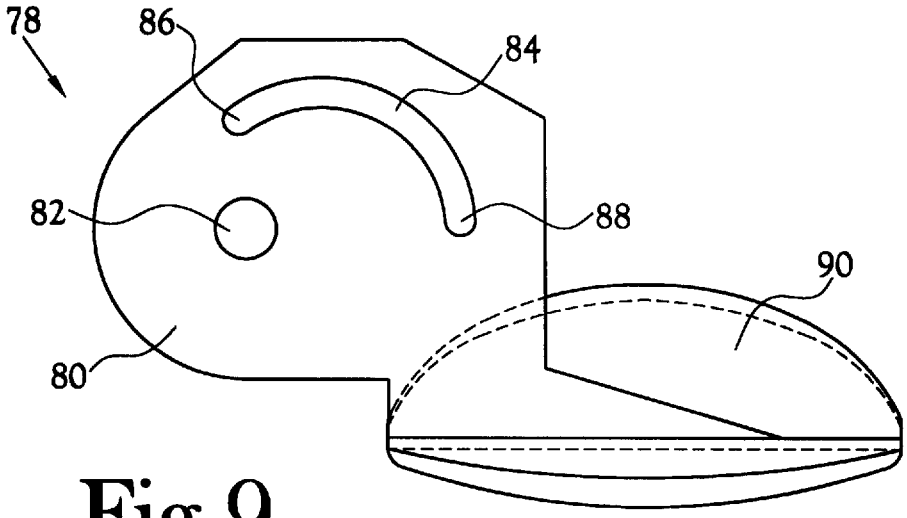
FIG. 9 illustrates a side view of a blade.
Figure 10:
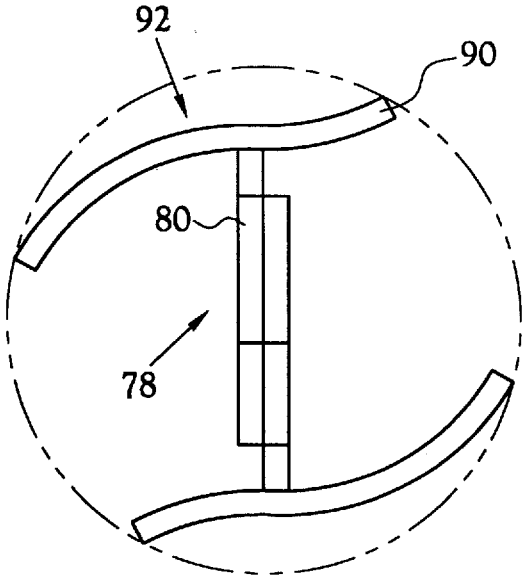
FIG. 10 is an end view of the agitator blades in a folded up or closed position.

Each blade 78 includes a blade arm 80 and an agitator blade 90 secured thereto, as shown in FIG. 9. The blade arm 80 defines a blade pivot pin opening 82 and a blade lifting pin slot 84. Preferably, the blade lifting pin slot 84 is quarter circular in shape and defines a first end 86 and second end 88. The agitator blade 90 is circular and, in the preferred embodiment, defines a bending detail 92, an end view of which is illustrated in FIG. 10. The bending detail 92 ensures more thorough mixing. Preferably, the agitator blade 90 is 2.294 inches in diameter.

The components of the retractable blade assembly 50 cooperate in the following manner. The lifting collar 52 is slidably received on the agitator shaft 60. The slots 54 of the lifting collar 52 are aligned with the blade arm slot 66 of the agitator shaft 60. The blade arm 80 of each blade 78 is inserted in the lifting collar slot 54 and the blade arm slot 66 such that the agitator blades 90 extend in opposing directions. The blade pivot pin opening 82 is aligned with the shaft pivot pin opening 70 and a pivot pin 96 is received therethrough such that the blades 78 pivot with respect to the pivot pin 96. A lifting pin 98 is received through the lifting pin openings 56 of the lifting collar 52, the shaft lifting pin slot 68 and the blade lifting pin slot 84 of each blade 78. The blade lifting pin slot 84 is configured to limit the range the blade 78 pivots to 90°, from a folded up or closed position to an extended or open position.

When the blades 78 are in the closed position, a portion of each blade arm 80 is received in the lifting collar slots 54 and the shaft blade arm slots 66, as shown in FIG. 2. The lifting collar 52 is raised with respect to the agitator shaft 60 and the lifting pin 98 is positioned at the upper end 72 of the shaft lifting pin slot 68 and at the second end 88 of the blade lifting pin slot 84, as shown in FIG. 2. FIG. 10 illustrates a top view of the blades 78 in a folded up or closed position. In the preferred embodiment, the diameter of the blade assembly 50 in a folded up position is approximately 2.75 inches such that it is receivable through the three inch opening 16 of the vat cover 14.

The blades 78 move from a closed position to an open position when the lifting collar 52 moves downward. When the blades 78 are in a fully open position, the lifting pin 98 is positioned at the lower end 74 of the shaft lifting pin slot 68 and at the first end 86 of the blade lifting pin slot 84, as shown in FIG. 4.

The agitator assembly 10 is constructed such that once the first end 30 of the drive shaft 28 is secured to the agitator drive 18 it need not be disconnected from the drive 18 to insert or remove the remaining portion of the agitator assembly 10 in or from a conventional vat 12. Specifically, the lower end of the agitator assembly 10 is disconnected from the drive shaft 28 via the quick release split coupling 40.

To insert the remaining portion of the agitator assembly 10, the retractable blade assembly 50 is situated in a closed position by raising the lifting collar 52 with respect to the agitator shaft 60 such that the blades 78 are fully retracted. With the blades 78 in a retracted position, the lower end of the agitator assembly 10 is inserted through the three inch opening 16 of the conventional vat cover 14. The lower portion 44 of the quick release split coupling 40 is interlocked to the upper portion 42 and the sheath 46 is brought down to maintain the portions 42, 44 in an interlocked position. Upon rotation of the agitator assembly 10 via the agitator drive 18, the blades 78 extend away from the agitator shaft 60 under centrifugal forces.

To remove the agitator assembly 10 from the vat 12, the sheath 46 of the quick release split coupling 40 is raised to reveal the interlocking site 47 to disconnect the lower portion 44 from the upper portion 42, and the agitator assembly 10 is pulled up through the vat cover opening 16. The blades 78 of the retractable blade assembly 50 are retracted by gripping the rim 56 of the collar 52 and pulling the collar 52 up with respect to the agitator shaft 60 thereby retracting the blades 78. With the blades 78 fully retracted, the retractable blade assembly 50 can be removed from the vat 12.

From the foregoing description, it will be recognized by those skilled in the art that an agitator shaft offering advantages over the prior art has been provided. Specifically, the agitator assembly includes blades which are retractable such that the assembly is receivable through the opening in the top cover of a conventional mixing vat. Moreover, the blades extend from the shaft under centrifugal forces. Also, the blades are positionable proximate the bottom of the vat to ensure thorough mixing of the contents in the vat. Further, the agitator assembly includes a means for quickly connecting and disconnecting the agitator assembly to and from the agitator drive.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention,

I claim:

1. An agitator assembly for mixing ingredients in a conventional food and beverage processing vat, said agitator assembly being driven by an agitator drive positioned above the vat and the vat includes a cover which defines an opening therein, said agitator assembly comprising:

a drive shaft defining a first end and a second end, said first end for securing to the agitator drive;

a main shaft defining a first end and a second end, said first end of said main shaft being releasably securable to said second end of said drive shaft, said main shaft being movable through the opening in the vat cover; and, a retractable blade assembly secured to said second end of said main shaft, said retractable blade assembly defining at least one blade, a lifting collar and an agitator shaft, said lifting collar being slidably received on said agitator shaft, a first end of said agitator shaft being secured to said second end of said main shaft via a shaft coupling, said lifting collar and said agitator shaft cooperating such that said at least one blade is retractable and extendable, said retractable blade assembly being movable through the opening in the vat cover when said at least one blade is retracted.

2. The agitator assembly of claim 1 further including a quick release split coupling, said second end of said drive shaft being secured to an upper end of said quick release split coupling, said first end of said main shaft being secured to a lower end of said quick release split coupling, said quick release split coupling being separable such that said main shaft is separable from said drive shaft.

3. The agitator assembly of claim 1 wherein said retractable blade assembly further includes an agitator shaft defining a first end and a second end, said first end of said agitator shaft being secured to said second end of said main shaft via a shaft coupling, said agitator shaft defining a blade arm slot, a shaft lifting pin slot and a shaft pivot pin opening each extending through said agitator shaft proximate said second end of said agitator shaft, said blade arm slot being disposed approximately 90° from said shaft lifting pin slot and said shaft pivot pin opening, said shaft lifting pin slot being positioned above said shaft pivot pin opening;

a lifting collar being cylindrical defining an upper end, a lower end, two axial slots and two lifting pin openings, said two axial slots being oppositely disposed and extending from said lower end of said lifting collar, said two lifting pin openings being oppositely disposed proximate said lower end of said lifting collar, said two lifting pin openings being disposed 90° from said two axial slots, said lifting collar being slidably received over said agitator shaft, said axial slots being alignable with said blade arm slot;

two blades each defining a blade arm and an agitator blade secured to said blade arm, said blade arm defining a blade lifting pin slot and a blade pivot pin opening, a portion of said blade arm of each of said two blades being receivable through said axial slots and in said blade arm slot of said agitator shaft, each of said two blades extending in opposing directions, said blade pivot pin opening of each of said two blades being alignable with said shaft pivot pin opening and receiving a pivot pin therethrough such that said two blades pivot with respect to said pivot pin, each of said blade lifting pin slots being alignable with said shaft lifting pin slot and said lifting pin openings and receiving a lifting pin therethrough such that when said lifting collar is raised with respect to said agitator shaft said two blades are lowered, and when said lifting collar is lowered with respect to said agitator shaft said two blades are retracted.

4. The agitator assembly of claim 3 wherein said lifting collar further defines a rim carried at said upper end thereof for gripping to raise and lower said lifting collar with respect to said agitator shaft.

5. The agitator assembly of claim 3 wherein said shaft lifting pin slot defines a first end and a second end and is configured to limit the range said two blades pivot with respect to said pivot pin.

6. The agitator assembly of claim 3 wherein each of said two blades are extendable via centrifugal forces generated when said agitator shaft is rotated via the agitator drive.

7. The agitator assembly of claim 3 wherein each of said agitator blades defines a bending detail.

8. The agitator assembly of claim 1 wherein said retractable blade assembly is releasably secured to said second end of said main shaft.

9. An agitator assembly for mixing ingredients in a conventional food and beverage processing vat, said agitator assembly being driven by an agitator drive positioned above the vat and the vat includes a cover which defines an opening therein, said agitator assembly comprising:

a shaft defining a first end and a second end, said first end for securing to the agitator drive, said shaft extending through the opening in the vat cover; and a retractable blade assembly defining an agitator shaft defining a first end and a second end, said first end of said agitator shaft being secured to said second end of said shaft, said agitator shaft further defining a blade arm slot, a shaft lifting pin slot and a shaft pivot pin opening each extending through said agitator shaft proximate said second end of said agitator shaft, said blade arm slot being disposed approximately 90° from said shaft lifting pin slot and said shaft pivot pin opening, said shaft lifting pin slot being positioned above said shaft pivot pin opening;

a lifting collar being cylindrical and defining an upper end, a lower end, two axial slots and two lifting pin openings, said two axial slots being oppositely disposed and extending from said lower end of said lifting collar, said two lifting pin openings being oppositely disposed proximate said lower end of said lifting collar, said two lifting pin openings being disposed 90° from said two axial slots, said lifting collar being slidably received over said agitator shaft such that said axial slots are aligned with said blade arm slot;

two blades each defining a blade arm and an agitator blade secured to said blade arm, said blade arm defining a blade lifting pin slot and a blade pivot pin opening, a portion of said blade arm of each of said two blades being receivable through said axial slots and in said blade arm slot of said agitator shaft, each of said two blades extending in opposing directions, said blade pivot pin opening of each of said two blades being alignable with said shaft pivot pin opening and receiving a pivot pin therethrough such that said two blades pivot with respect to said pivot pin, each of said blade lifting pin slots being alignable with said shaft lifting pin slot and said lifting pin openings and receiving a lifting pin therethrough such that when said lifting collar is raised with respect to said agitator shaft said two blades are lowered and when said lifting collar is lowered with respect to said agitator shaft said two blades are retracted, said retractable blade assembly being movable through the opening in the vat cover when said two blades are retracted.

10. The agitator assembly of claim 9 wherein said shaft lifting pin slot defines a first end and a second end and is configured to limit the range said two blades pivot with respect to said pivot pin.

11. The agitator assembly of claim 9 wherein said lifting collar further defines a rim carried at said upper end thereof for gripping to raise and lower said lifting collar with respect to said agitator shaft.

12. The agitator assembly of claim 9 wherein each of said agitator blades defines a bending detail.

13. An agitator assembly for mixing ingredients in a conventional food and beverage processing vat, said agitator assembly being driven by an agitator drive positioned above the vat and the vat includes a cover which defines an opening therein, said agitator assembly comprising:

a shaft defining a first end and a second end, said first end for securing to the agitator drive, said shaft extending through the opening in the vat cover; and a retractable blade assembly defining an agitator shaft defining a first end and a second end, said first end of said agitator shaft being secured to said second end of said shaft, said agitator shaft further defining a blade arm slot, a shaft lifting pin slot and a shaft pivot pin opening each extending through said agitator shaft proximate said second end of said agitator shaft, said blade arm slot being disposed approximately 90° from said shaft lifting pin slot and said shaft pivot pin opening, said shaft lifting pin slot being positioned above said shaft pivot pin opening;

a lifting collar being cylindrical and defining an upper end, a lower end, two axial slots and two lifting pin openings, said two axial slots being oppositely disposed and extending from said lower end of said lifting collar, said two lifting pin openings being oppositely disposed proximate said lower end of said lifting collar, said two lifting pin openings being disposed 90° from said two axial slots, said lifting collar being slidably received over said agitator shaft such that said axial slots are aligned with said blade arm slot;

two blades each defining a blade arm and an agitator blade secured to said blade arm, said blade arm defining a blade lifting pin slot and a blade pivot pin opening, a portion of said blade arm of each of said two blades being receivable through said axial slots and in said blade arm slot of said agitator shaft, each of said two blades extending in opposing directions, said blade pivot pin opening of each of said two blades being alignable with said shaft pivot pin opening and receiving a pivot pin therethrough such that said two blades pivot with respect to said pivot pin, each of said blade lifting pin slots being alignable with said shaft lifting pin slot and said lifting pin openings and receiving a lifting pin therethrough such that when said lifting collar is raised with respect to said agitator shaft said two blades are lowered and when said lifting collar is lowered with respect to said agitator shaft said two blades are retracted, said retractable blade assembly being movable through the opening in the vat cover when said two blades are retracted, each of said two blades being extendable via centrifugal forces generated when said agitator shaft is rotated.

14. The agitator assembly of claim 13 wherein said lifting collar further defines a rim carried at said upper end thereof for gripping to raise and lower said lifting collar with respect to said agitator shaft.

15. The agitator assembly of claim 13 wherein each of said agitator blades defines a bending detail.

16. The agitator assembly of claim 13 wherein said shaft lifting pin slot defines a first end and a second end and is configured to limit the range said two blades pivot with respect to said pivot pin.

* * * * *